US011224882B2

(12) United States Patent
Sawa et al.

(10) Patent No.: US 11,224,882 B2
(45) Date of Patent: Jan. 18, 2022

(54) ROTOR THAT IMPROVES OPERABILITY OF SAMPLE CONTAINERS AND CENTRIFUGE IN WHICH SAME IS USED

(71) Applicant: Eppendorf Himac Technologies Co., Ltd., Ibaraki (JP)

(72) Inventors: Yusuke Sawa, Ibaraki (JP); Jun Sato, Ibaraki (JP)

(73) Assignee: Eppendorf Himac Technologies Co., Ltd., Ibaraki (JP)

( * ) Notice: Subject to any disclaimer, the term of this patent is extended or adjusted under 35 U.S.C. 154(b) by 559 days.

(21) Appl. No.: 16/304,143

(22) PCT Filed: Apr. 28, 2017

(86) PCT No.: PCT/JP2017/016971
§ 371 (c)(1),
(2) Date: Nov. 22, 2018

(87) PCT Pub. No.: WO2017/208712
PCT Pub. Date: Dec. 7, 2017

(65) Prior Publication Data

US 2020/0316615 A1 Oct. 8, 2020

(30) Foreign Application Priority Data

May 31, 2016 (JP) ..... JP2016-109124

(51) Int. Cl.
*B04B 5/04* (2006.01)
*B04B 5/02* (2006.01)
*B04B 7/08* (2006.01)

(52) U.S. Cl.
CPC ..... *B04B 5/0414* (2013.01); *B04B 5/02* (2013.01); *B04B 7/08* (2013.01)

(58) Field of Classification Search
CPC ..... B04B 5/0414; B04B 5/02; B04B 7/08
(Continued)

(56) References Cited

U.S. PATENT DOCUMENTS 5,484,381 A * 1/1996 Potter ..... B04B 5/0414 494/12
5,728,038 A * 3/1998 Coffey ..... B04B 5/0414 494/16
5,840,005 A * 11/1998 Lowe ..... B04B 7/08 494/16

FOREIGN PATENT DOCUMENTS

JP 08309232 A * 11/1996 ..... B04B 5/0414
JP H08309232 11/1996
(Continued)

OTHER PUBLICATIONS

"International Search Report (Form PCT/ISA/210) of PCT/JP2017/016971," dated Jun. 6, 2017, with English translation thereof, pp. 1-2.

*Primary Examiner* — Walter D. Griffin
*Assistant Examiner* — Shuyi S. Liu
(74) *Attorney, Agent, or Firm* — JCIPRNET

(57) ABSTRACT

The purpose of the present invention is to provide a small rotor for a centrifuge, the rotor being configured such that numerous sample containers can be mounted simultaneously and it is easy to take out the sample containers. In an inner peripheral surface 20A of an outer wall part 20, recessed areas 20B locally carved outward are provided in areas between sample container insertion holes 11 that are adjacent to each other in a circumferential direction. In the locations of the recessed areas 20B, the spaces between adjacent sample containers 51 are wider, and the sample containers 51 can easily be taken out.

11 Claims, 5 Drawing Sheets

(58) Field of Classification Search
USPC ..... 494/16
See application file for complete search history.

(56) References Cited

FOREIGN PATENT DOCUMENTS

| | | | | | |
|---|---|---|---|---|---|
| JP | 09262503 | A | * | 10/1997 | ..... B04B 5/0414 |
| JP | 2004049970 | | | 2/2004 | |
| JP | 2012035261 | | | 2/2012 | |

* cited by examiner

ROTOR THAT IMPROVES OPERABILITY OF SAMPLE CONTAINERS AND CENTRIFUGE IN WHICH SAME IS USED

CROSS-REFERENCE TO RELATED APPLICATION

This application is a 371 application of the international PCT application serial no. PCT/JP2017/016971, filed on Apr. 28, 2017, which claims the priority benefit of Japan application no. 2016-109124, filed on May 31, 2016. The entirety of each of the abovementioned patent applications is hereby incorporated by reference herein and made a part of this specification.

TECHNICAL FIELD

The disclosure relates to a structure of a rotor that is rotationally driven in a state in which a plurality of sample containers are attached in a centrifuge that applies a centrifugal force to a sample by causing a sample container having the sample accommodated therein to rotate at a high speed. Alternatively, the disclosure relates to a structure of a centrifuge using the rotor.

BACKGROUND ART

A centrifuge (a centrifugal separator) is used to separate a sample (for example, a culture solution or blood) into materials having different densities or to rectify or analyze a sample using a centrifugal force at the time of rotation at a high speed. In a centrifuge, in a state in which a sample container having a sample sealed therein is attached thereto, a metallic rotor rotates about a central axis (a rotation axis) extending in a vertical direction, for example, at a high speed of about 20000 rpm. Accordingly, a sample container insertion hole into which a sample container is inserted and attached is provided in the rotor. A structure of such a rotor is described, for example, in Patent Literature 1.

A perspective view of such a rotor 200 is illustrated in FIG. 8, and a sectional view taken in a vertical direction along a central axis X is illustrated in FIG. 10. Here, a state in which two types of ten large-diameter sample containers 51 and ten small-diameter sample containers are attached to a sample container accommodating section which is a section in which sample containers are attached and accommodated inside the rotor 200 is illustrated. The top of the rotor 200 is actually sealed with a lid in this state at the time of processing of centrifugal separation, but the lid is not illustrated. The rotor 200 is rotationally driven with a central axis X as a rotation axis inside a rotor chamber which is a sealed space.

As illustrated in FIG. 9, a large sample container 51 is attached in a sample container insertion hole 61 outside as viewed from the central axis, a small sample container 52 is attached in a sample container insertion hole (an inner sample container insertion hole) 62 inside therefrom, and the sample container insertion holes 61 and 62 are arranged such that the centers thereof in a top view are arranged along a circumference centered on the central axis X. A sectional surface at a certain position of the sample container insertion hole 61 (the sample container 51) is illustrated in the left part of FIG. 10, and a sectional surface at a certain position of the sample container insertion hole 62 (the sample container 52) is illustrated in the right part of FIG. 10. As illustrated in FIG. 10, the sample container 51 includes a tubular sample container body 511 with a bottom (one end) closed at the time of attachment and a cap 512 that is attached to seal a top (the other end) opening, and can accommodate and seal a sample in the sample container body 511. Similarly, the sample container 52 includes a sample container body 521 and a cap 522.

The sample containers 51 and 52 are inserted and attached in the sample container insertion holes 61 and 62 which are holes formed in a rotor bottom surface (bottom surface) 60A which is an upward surface of a rotor body 60 from above. As illustrated in FIG. 10, the sample container insertion holes 61 and 62 dig obliquely downward into the rotor bottom surface 60A outward from the central axis X side and are formed such that the sample container bodies 511 and 521 are accommodated therein. The caps 512 and 522 have larger diameters than the sample container bodies 511 and 521, and are not accommodated in the sample container insertion holes 61 and 62 but are located above the sample container insertion holes 61 and 62 at the time of attachment of the sample containers 51 and 52. An outer wall portion 70 having a substantially cylindrical inner circumferential surface 70A surrounding the top side of the attached sample containers 51 and 52 around the central axis X is provided in the upper part of the rotor body 60.

Accordingly, it is possible to stably hold the sample containers 51 and 52 by their dead weight in a state in which the sample containers 51 and 52 are attached in the sample container insertion holes 61 and 62 from above, and to apply a centrifugal force to samples therein while stably holding the sample containers 51 and 52 by causing the rotor 200 to rotate about the central axis X in this state. At this time, a centrifugal separation process can be simultaneously performed on a large amount of samples by simultaneously attaching a plurality of sample containers 51 and 52. At this time, in FIG. 10, the sample container bodies 511 and 521 to which an outward strong centrifugal force is applied are mechanically supported over a depth direction of the sample container insertion holes 61 and 62 by outer portions of the sample container accommodating section of the sample container insertion holes 61 and 62 (sample container support areas 61A and 62A). Accordingly, even when a strong centrifugal force is applied, the thin and long sample containers 51 and 52 are prevented from being bent and destroyed. At this time, since the sample container support areas 61A and 62A are formed in a structure in which the rotor bottom surface 60A and the outer wall portion 72 are unified, it is possible to particularly stably hold and protect the sample containers 51 and 52.

Similarly to the sample container insertion holes 61 and 62 (the sample containers 51 and 52), more sample containers or sample containers with three or more types of sizes may be simultaneously attached to a single rotor by employing a configuration in which sample containers can be attached on more circumferences. Accordingly, it is possible to simultaneously perform a centrifugal separation process on a large amount of samples using a single rotor.

In the above-mentioned configuration, when the rotor 200 stops, the attached sample containers 51 and 52 are held in the sample container insertion holes 61 and 62 by their dead weight. Accordingly, an operator may take the sample containers 51 and 52 out of the rotor 200 by gripping the caps 512 and 522 at the top ends of the sample containers 51 and 52 with her or his fingers and pulling the sample containers 51 and 52 obliquely upward along the sample container insertion holes 61 and 62.

CITATION LIST

Patent Literature

[Patent Literature 1]
Japanese Patent Application Laid-Open No. 2012-35261

SUMMARY OF INVENTION

Technical Problem

Here, in order to secure the number of sample containers 51 and 52 which can be accommodated in the rotor without increasing the size of the rotor 200, it is necessary to decrease the intervals between neighboring sample containers 51 (sample container insertion holes 61) or between neighboring sample containers 52 (sample container insertion holes 62). This also decreases the gap between the inner circumferential surface 70A of the outer wall portion 70 and the outer sample containers 51. In this case, it is difficult to secure a space into which a finger is inserted between the sample containers 52 and it is difficult to secure such a space particularly when large caps 512 and caps 522 are used. Accordingly, when the sample containers 51 and 52 are attached in all the sample container insertion holes 61 and 62 which are arranged on the circumferences, it is not easy to take out the sample containers 51 and 52.

On the other hand, when the intervals between the sample container insertion holes 61 and between the sample container insertion holes 62 are increased such that the intervals between neighboring sample containers 51 and between neighboring sample containers 52 are increased to a size into which an operator's finger can be inserted, the size of the rotor 200 increases. In order to rotationally drive such a large rotor 200, a centrifuge has to be increased in size as a whole and power consumption thereof has to be increased.

For example, when a configuration in which a structure in contact with the sample containers 51 is not provided around the top ends of the attached sample containers 51 and a large space is formed around the top ends of the sample containers 51 is employed, it is clearly easy to take out the sample containers 51. However, as described above, in order to support the sample containers 51 when a strong centrifugal force is applied thereto, it is necessary to provide sample container support areas. 61A supporting the sample containers 51 from the outside on the outside of the sample containers 61A, and there is concern that the sample containers 51 (the sample container bodies 511) will be bent and destroyed due to the strong centrifugal force when the top of each sample container 51 is not supported from the outside. The same is true of the surroundings of the sample containers 52. Accordingly, from the viewpoint of holding the sample containers 51 and 52, it is difficult to apply this configuration.

Accordingly, a small rotor to which a plurality of sample containers can be simultaneously attached and from which the sample containers can be easily taken out has been required for a centrifuge.

The disclosure was made in consideration of such a problem and an objective thereof is to provide a structure capable of solving such a problem.

Solution to Problem

In order to achieve the above-mentioned objective, the disclosure employs the following configurations. A rotor according to the disclosure is a rotor that is mounted in a centrifuge and is rotationally driven about a rotation axis in a vertical direction in a state in which a plurality of sample containers having samples accommodated therein are attached in a sample container accommodating section, wherein the sample container accommodating section includes a plurality of sample container insertion holes which are arranged such that centers of the holes are arranged along a first circumference around the rotation axis, and in the sample container accommodating section, sample container support areas in contact with the sample containers are provided in an area on the outside in a radial direction from the rotation axis when the sample containers are attached in the sample container insertion holes, and local cutout areas are provided between neighboring sample container insertion holes in an area on the outside in the radial direction from the first circumference. In the rotor according to the disclosure, a width of each of the cutout areas in a circumferential direction around the rotation axis in a top view is larger than a gap between two sample containers attached in two neighboring sample container insertion holes in the direction of the first circumference. In the rotor according to the disclosure, the cutout areas are formed such that an operator can contact a top lateral surface of each of the sample containers. In the rotor according to the disclosure, the sample container support areas are in contact with the top lateral surfaces of the sample containers. In the rotor according to the disclosure, the cutout areas are formed at a height at which the sample container support areas are located in the vertical direction. In the rotor according to the disclosure, the rotor includes an outer wall portion which is provided on the outside and the upper side in the radial direction of the sample container accommodating section, and the cutout areas are formed from an inner circumferential surface of the outer wall portion to a height at which the sample container support areas are located. In the rotor according to the disclosure, the sample container support areas are formed integrally with the outer wall portion. In the rotor according to the disclosure, the cutout areas are provided on both sides of one of the sample container insertion holes in the circumferential direction around the rotation axis. In the rotor according to the disclosure, the sample container insertion holes and the cutout areas are alternately arranged in the circumferential direction around the rotation axis. In the rotor according to the disclosure, the rotor further includes a plurality of inner sample container insertion holes which are holes in which the plurality of sample containers are attached, and the centers of the inner sample container insertion holes are arranged along a second circumference which is smaller than the first circumference around the rotation axis. In the rotor according to the disclosure, each of the sample containers includes: a tubular sample container body in which the sample is accommodated and of which one end is sealed; and a cap that is attached to the other end of the sample container body and which has a larger diameter than the sample container body. A centrifuge according to the disclosure employs the rotor and is configured to be a structure that applies a centrifugal force to the samples in the sample containers attached to the rotor.

Advantageous Effects of Invention

Since the disclosure has the above-mentioned configurations, it is possible to provide a small rotor to which a plurality of sample containers can be simultaneously attached and from which the sample containers can be easily taken out in a centrifuge.

DESCRIPTION OF EMBODIMENTS

Figure 1:
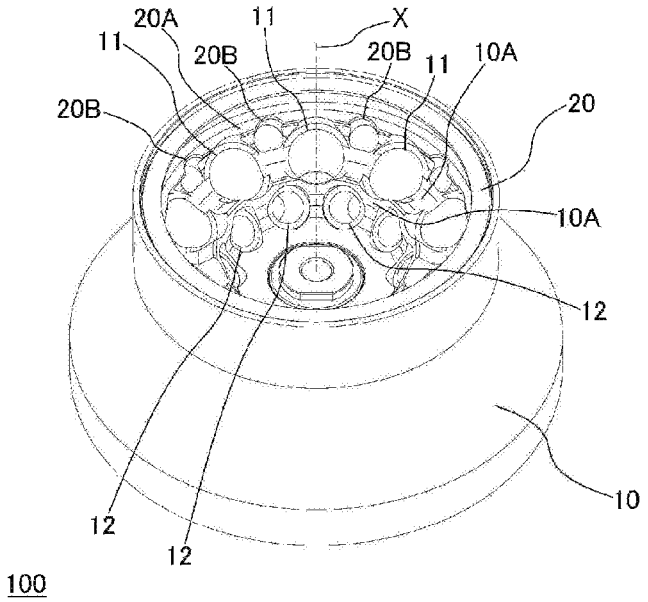
FIG. 1 is a perspective view of a rotor according to an embodiment of the disclosure in a state in which sample containers are not attached thereto.
Figure 2:
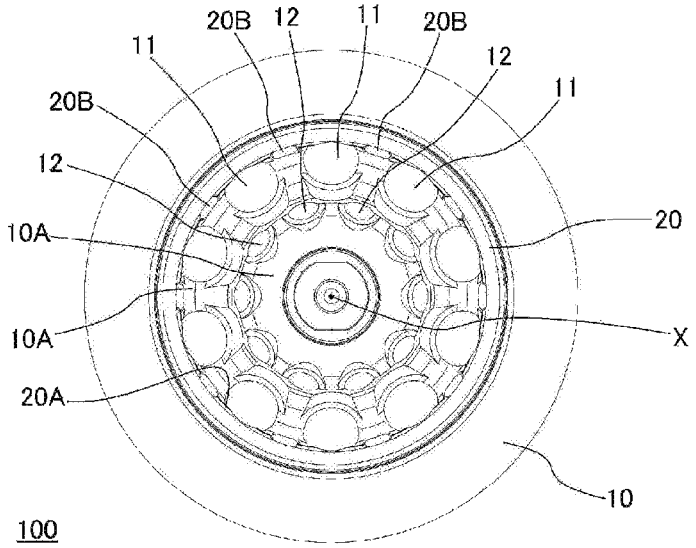
FIG. 2 is a top view of the rotor according to the embodiment of the disclosure in a state in which sample containers are not attached thereto.
Figure 3:
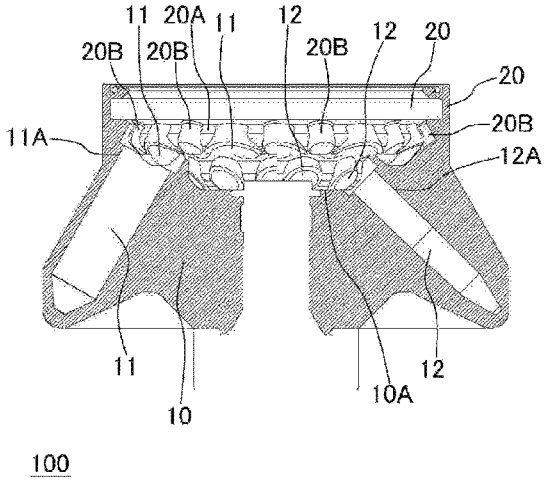
FIG. 3 is a sectional view taken along a rotation axis of the rotor according to the embodiment of the disclosure in a state in which sample containers are not attached thereto.
Figure 4:
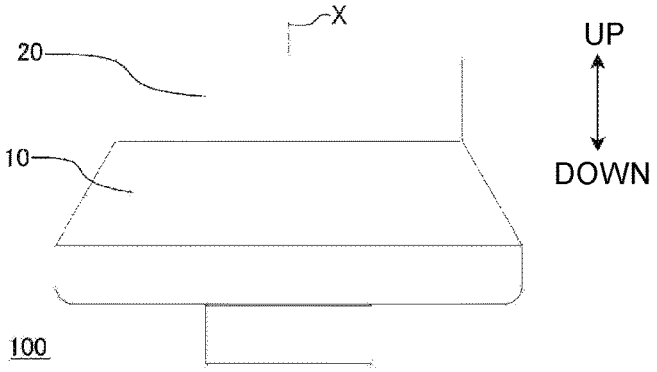
FIG. 4 is a side view of appearance of the rotor according to the embodiment of the disclosure.

A rotor according to an embodiment of the disclosure will be described below. This rotor is used for a centrifuge (a centrifugal separator) such that a plurality of sample containers having samples to be centrifugally separated accommodated therein are attached to the rotor and a centrifugal force is applied to the samples, similarly to the rotor 200. A perspective view of the rotor 100 is illustrated in FIG. 1, a top view thereof is illustrated in FIG. 2, a sectional view in a vertical direction along a central axis is illustrated in FIG. 3, and a side view of appearance thereof is illustrated in FIG. 4. FIGS. 1 to 3 illustrate a state in which sample containers are not attached to the rotor.

Large-diameter sample containers 51 and small-diameter sample containers 52 (which are not illustrated in FIGS. 1 to 3) can be attached to the rotor 100. Accordingly, in the rotor 100, sample container insertion holes 11 and sample container insertion holes (inner sample container insertion holes) 12 are also arranged along a circumference centered on a central axis X on a rotor bottom surface (a bottom surface) 10A which is a top surface of a rotor body 10. Here, in FIG. 2 which is a top view, the centers of the sample container insertion holes 11 are arranged at equal intervals along a large circumference (a first circumference) and the centers of the sample container insertion holes 12 are arranged at equal intervals along a small circumference (a second circumference) inside the first circumference. In a top view, an outer wall portion 20 including a substantially cylindrical inner circumferential surface 20A surrounding the sample containers 51 and 52 around the central axis X is provided on the upper side of a rotor body 10. Accordingly, a sample container accommodating section constituting the inside in which the sample containers 51 and 52 are accommodated in the rotor 100 is configured to be strong by unification of the rotor bottom surface 10A and the outer wall portion 20, similarly to the above-mentioned rotor 200. In FIG. 2, which is a top view, the inner circumferential surface 20A is formed along a circumference (a third circumference) larger than the first circumference. The sample containers 51 and 52 are attached to the rotor bottom surface 10A. A sectional surface at a position at which the sample container insertion holes 11 are located is illustrated in the left part of FIG. 3, and a sectional surface at a position at which the sample container insertion holes 12 are located is illustrated in the right part of FIG. 3.

Figure 5:
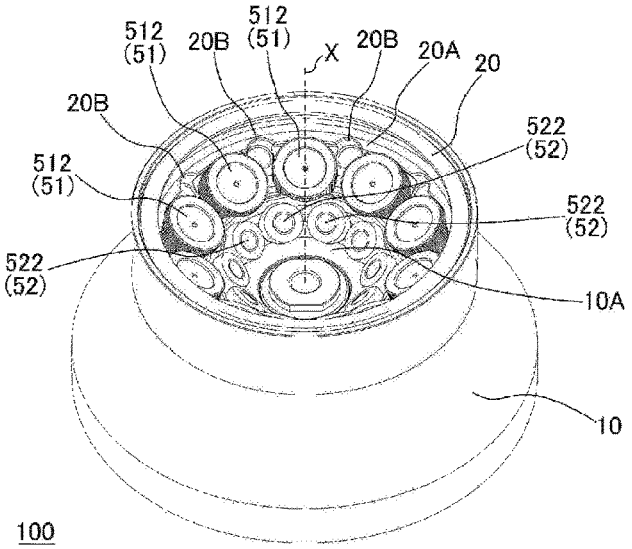
FIG. 5 is a perspective view of the rotor according to the embodiment of the disclosure in a state in which sample containers are attached thereto.
Figure 6:
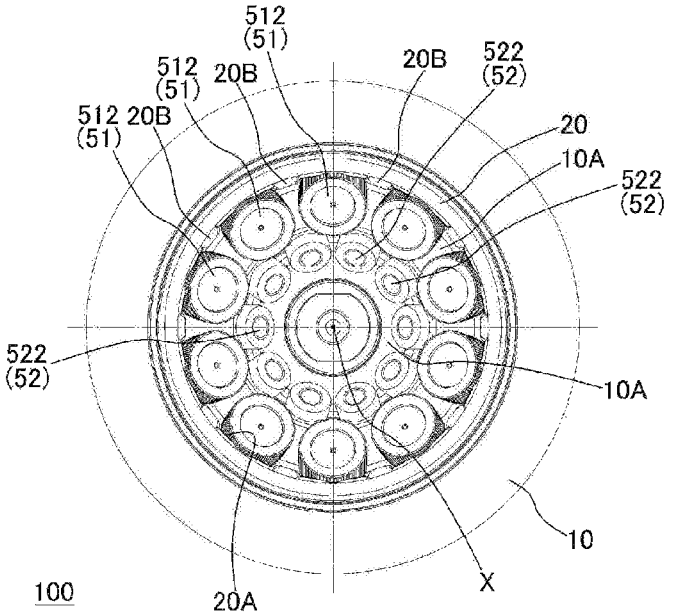
FIG. 6 is a top view of the rotor according to the embodiment of the disclosure in a state in which sample containers are attached thereto.
Figure 7:
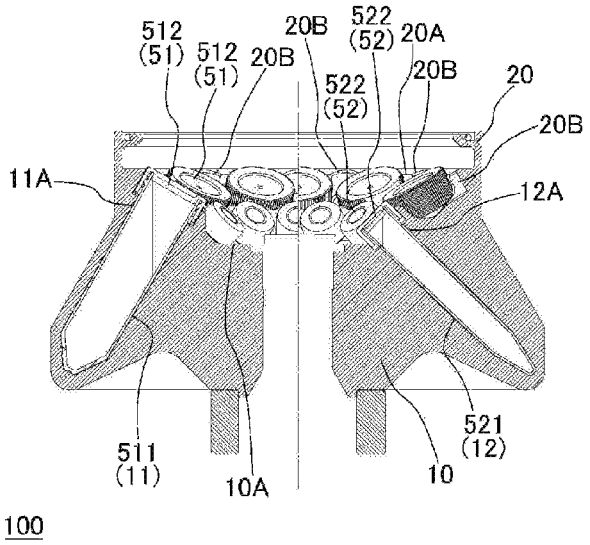
FIG. 7 is a sectional view taken along a rotation axis of the rotor according to the embodiment of the disclosure in a state in which sample containers are attached thereto.
Figure 8:
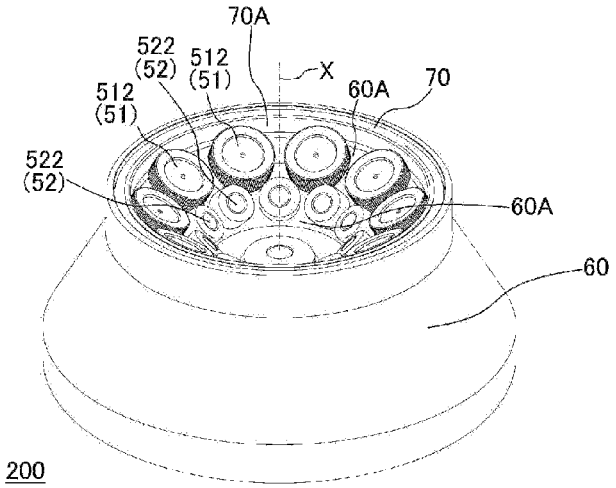
FIG. 8 (PRIOR ART)
FIG. 8 is a perspective view of a rotor according to the related art in a state in which sample containers are attached thereto.
Figure 9:
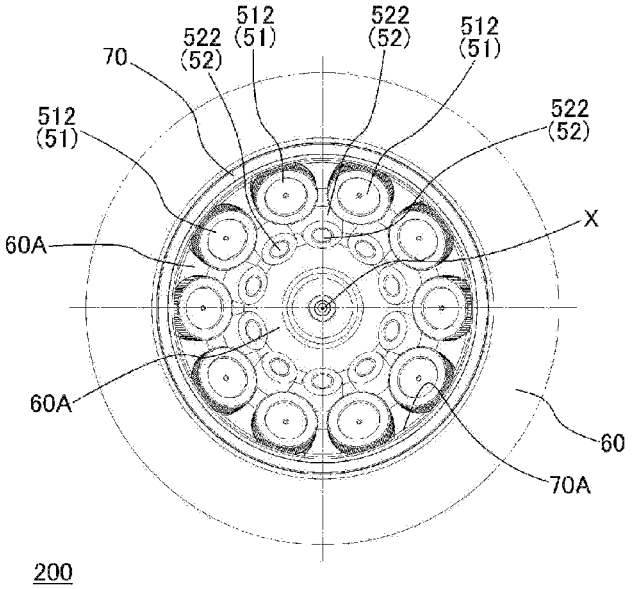
FIG. 9 (PRIOR ART)
FIG. 9 is a top view of the rotor according to the related art in a state in which sample containers are attached thereto.
Figure 10:
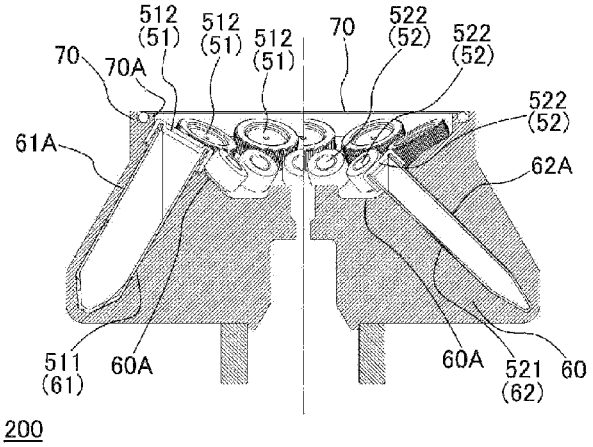
FIG. 10 (PRIOR ART)
FIG. 10 is a sectional view taken along a rotation axis of the rotor according to the related art in a state in which sample containers are attached thereto.

A perspective view when the sample containers 51 are attached in all the sample container insertion holes 11 in the rotor 100 and the sample containers 52 are attached in all the sample container insertion holes 12 is illustrated in FIG. 5, a top view thereof is illustrated in FIG. 6, and a sectional view in the vertical direction along the central axis X is illustrated in FIG. 7. FIGS. 5 to 7 correspond to FIGS. 8 to 10 of the rotor 200 according to the related art.

As illustrated in FIGS. 1 and 2, on the inner circumferential surface 20A of the outer wall portion 20, cutout areas 20B which are locally recessed outward are provided in areas between the sample container insertion holes 11 adjacent in the circumferential direction. As illustrated in FIGS. 5 and 6, the cutout areas 20B are located outside areas between neighboring sample containers 51 (caps 512) when the sample containers 51 are attached. Accordingly, at the locations at which the cutout areas 20B are located, a space between the neighboring sample containers 51 (the caps 512) is widened, an operator can insert a finger into the space even when a gap between the neighboring sample containers 51 is small. When a certain sample container 51 is taken out, the operator can insert the finger into the locations of the cutout areas 20B on both sides thereof, grip the sample container 51, and easily take out the sample container 51. Particularly, as illustrated in FIG. 7, since the sample container 51 is supported by a sample container support area 11A even on the outside of a top lateral surface thereof, the top of the sample container 51 was not easily gripped from the outside from the central axis X, but the top lateral side of the sample container 51 can be easily gripped by providing the cutout area 20B.

As illustrated in FIG. 7, the sample container insertion hole 11 is formed to correspond to the shape of the sample container body 511, the sample container 51 is supported by the sample container support area 11A which is an outside part of the sample container insertion hole 11 when the rotor 100 rotates, and the cutout area 20B is formed in a part not associated with support of the sample container 51 on the outer wall portion 20. Accordingly, as illustrated in FIGS. 5 and 7, the height at which the sample container support areas 11A are located in the vertical direction and the height at which the cutout areas 20B are located overlap each other, but the strength for supporting the sample containers 51 is not decreased by providing the cutout areas 20B.

In the rotor 100, ten sample container insertion holes 11 (sample containers 51) are arranged at equal intervals on the first circumference on the outside around the central axis X, and ten sample container insertion holes 12 (sample containers 52) are arranged at equal intervals on the second circumference on the inside. The inner circumferential surface 20A of the outer wall portion 20 constituting the circumference (the third circumference) around the central axis X are provided as described above, and the cutout areas 20B are also formed at equal intervals on the inner circumferential surface 20A in the circumferential direction. Accordingly, weight balance around the central axis X in the rotor 100 is maintained.

Since an applied centrifugal force is small in the vicinity of the central axis X, a configuration to which a sample container is attached is not generally provided in the vicinity of the central axis X. Accordingly, in FIGS. 1 and 3, there is no structure on the inside (the side closer to the central axis X) of the inner sample container insertion holes 12. Since the area inside the sample container insertion holes 12 to which the sample containers 52 are attached does not contribute to supporting of the sample containers 52 when a centrifugal force is applied thereto. Accordingly, even when the rotor bottom surface 10A inside the sample container insertion holes 12 is thinned downward, the sample containers 52 can be satisfactorily mechanically supported at the time of rotation and it is possible to secure a space into which a finger can be inserted. On the other hand, similarly to the sample container support area 11A, the area outside the sample container insertion holes 12 serve as sample container support areas 12A that mechanically support the sample containers 52 at the time of rotation of the sample containers 52 and thus requires a large mechanical strength. Accordingly, it is not preferable that the rotor bottom surface 10A outside the sample container insertion holes 12 be thinned.

When the rotor bottom surface 10A inside the sample container insertion holes (the inner sample container insertion holes) 12 is thinned to secure a space in this way, the inner sample containers 52 can be easily detached regardless of whether the cutout areas 20B are provided even in a state in which the sample containers 51 and 52 are attached to all the sample container insertion holes 11 and 12. When one sample container 52 is detached, a space is formed inside the sample container 51 (the side closer to the central axis X). However, when the rotor bottom surface 10A outside the sample container insertion holes 12 and inside the sample container insertion holes 11 is not thinned, it is not easy to take out the outer sample containers 51 using only the inside space.

In the rotor 100, each sample container 51 can be gripped and taken out using three fingers using the space formed at the positions of the cutout areas 20B on both sides of the corresponding sample container insertion hole 11 in addition to the space inside the sample container insertion holes 11 in this case. At this time, in a state in which the sample container support areas 11A are provided outside the sample containers 51, the cutout areas 20B can be provided, and the space into which the finger can be inserted can be provided adjacent to the sample containers 51 even when the sample container insertion holes 11 (the sample containers 51) adjacent to each other on the circumference get close and the outer wall portion 20 gets close to the outside of the sample containers 51. Accordingly, even when the number of sample containers 51 which are attachable increases, it is possible to easily attach and detach the sample containers 51 without increasing the size of the rotor 100.

Here, in order to secure a space into which a finger is inserted, it is preferable that a width of each cutout area 20B on the circumference (the third circumference) along the inner circumferential surface 20A of the outer wall portion 20 be set to be large and it is preferable that the width be set to be larger than the gap along the circumference (the first circumference) between the neighboring sample containers 51 (the caps 512). In this case, even when the gaps between the sample containers 51 are narrowed and the number of sample containers 51 to be attached is increased, it is possible to widen the spaces at the locations at which the cutout areas 20B are provided and to easily take out the sample container 51 by inserting a finger into the location at which the cutout area 20B is provided.

Each cutout area 20B is formed with a predetermined width in the vertical direction on the outer wall portion 20 (the sample container accommodating section), but when the cutout area 20B is formed from the uppermost of the outer wall portion 20 to the rotor bottom surface 10A or the height at which the sample container support area 11A is located, it is possible to easily take out the sample container 51 by inserting a finger into the location at which the cutout area 20B is formed from above. By forming the cutout area in the sample container accommodating section to connect to the sample container insertion hole, it is particularly easy to take out the sample container. In this case, all the sample container insertion holes do not need to be connected to the cutout areas, and it is particularly easy to take out the sample container by connecting at least one sample container insertion hole to the cutout area. By taking out the sample container, other sample containers can be easily taken out.

Two types of sample containers 51 and 52 can be attached to the rotor 100, but only one type of sample containers may be arranged on a single circumference in a smaller rotor. In this case, when sample container insertion holes are provided along the circumference in a top view and an outer wall portion is provided on the outside of the sample containers, provision of sample container support areas and cutout areas as described above is effective.

On the other hand, sample containers can be attached inside the sample containers 52 in a larger rotor, and the rotor may be configured to attach three or more types of sample containers thereto. In this case, by thinning the rotor bottom surface inside the innermost sample containers as described above, the innermost sample containers can be easily taken out and the sample containers can be sequentially taken out form the innermost sample containers. By providing the cutout areas, the outermost sample containers which it is most difficult to take out can be taken out finally.

By providing the cutout areas as described above, it is also possible to achieve a decrease in weight of the rotor as a whole. At this time, a strongest centrifugal force is applied to the outside of the outermost sample containers, but the cutout areas are formed between neighboring sample containers and thus a large force is not applied to the locations at which the cutout areas are formed. Accordingly, even when the cutout areas are provided as described above, tolerance of the rotor is maintained. That is, it is possible to decrease the weight of the rotor without damaging the tolerance.

In the above-mentioned example, the cutout areas 20B are formed on the inner circumferential surface 20A (the outer wall portion 20), but may be provided on the rotor bottom surface. For example, when a cutout area which is recessed downward in the rotor bottom surface is provided on the outside of an inner sample container insertion hole 12 and both sides in the circumferential direction thereof, it is easy to take out the inner sample container 52. At this time, it is apparent as described that a sample container support area 12A supporting the sample container 52 or a strength thereof can be secured. In this case, an area inside the outer sample container insertion hole 11 (the sample container 51) is thin in the cutout area, but since a large strength is not applied to the area at the time of rotation, the thin area does not adversely affect the tolerance of the rotor. In this way, the cutout area can be formed in the sample container accommodating section (such as the rotor bottom surface or the outer wall portion) which is a section in which the sample containers are attached and accommodated inside the rotor depending on the configuration of the sample container of which detachment is to be facilitated or the rotor. The shape of the cutout area can be appropriately set accordingly.

In the above-mentioned configuration, the sample container in which a cap having a larger diameter than the sample container body is attached to the top thereof is used, but the shape and the structure of the sample container are not particularly limited as long as a centrifugal force can be applied to a sample in the sample container in a state in which the sample container is attached into the sample container insertion hole as described above.

The invention claimed is:

1. A rotor that is mounted in a centrifuge and is rotationally driven about a rotation axis in a vertical direction in a state in which a plurality of sample containers having samples accommodated therein are attached in a sample container accommodating section, wherein the sample container accommodating section includes a plurality of sample container insertion holes which are arranged such that centers of the holes are arranged along a first circumference around the rotation axis, and in the sample container accommodating section, an outer wall portion is provided on the outside and the upper side in the radial direction of the sample container accommodating section, the outer wall portion has an inner circumferential surface inside therefrom, and local cutout areas are formed between neighboring sample container insertion holes in an area on the outside in the radial direction from the first circumference and on the inner circumferential surface.

2. The rotor according to claim 1, wherein a width of each of the cutout areas in a circumferential direction around the rotation axis in a top view is larger than a gap between two sample containers attached in two neighboring sample container insertion holes in the direction of the first circumference.

3. The rotor according to claim 1, wherein the cutout areas are formed such that an operator can contact a top lateral surface of each of the sample containers.

4. The rotor according to claim 1, sample container support areas in contact with the sample containers are provided in an area on the outside in a radial direction from the rotation axis when the sample containers are attached in the sample container insertion holes, wherein the sample container support areas are in contact with the top lateral surfaces of the sample containers.

5. The rotor according to claim 1, wherein the cutout areas are formed at a height at which e sample container support areas are located in the vertical direction.

6. The rotor according to claim 1, wherein the sample container support areas are formed integrally with the outer wall portion.

7. The rotor according to claim 1, wherein the cutout areas are provided on both sides of one of the sample container insertion holes in the circumferential direction around the rotation axis.

8. The rotor according to claim 1, wherein the sample container insertion holes and the cutout areas are alternately arranged in the circumferential direction around the rotation axis.

9. The rotor according to claim 1, wherein the rotor further comprises a plurality of inner sample container insertion holes which are holes in which the plurality of sample containers are attached, and wherein the centers of the inner sample container insertion holes are arranged along a second circumference which is smaller than the first circumference around the rotation axis.

10. The rotor according to claim 1, wherein each of the sample containers comprises: a tubular sample container body in which the sample is accommodated and of which one end is sealed; and a cap that is attached to the other end of the sample container body and which has a larger diameter than the sample container body.

11. A centrifuge employing the rotor according to claim 1, the centrifuge being configured to be a structure that applies a centrifugal force to the samples in the sample containers attached to the rotor.

* * * * *